United States Patent [19]

Heine et al.

[11] Patent Number: 4,820,566

[45] Date of Patent: Apr. 11, 1989

[54] TUFTED CARPET WITH TUFTS OF FINE FIBERS AND TUFTS OF CRIMPED COARSE FIBERS

[75] Inventors: Richard F. Heine; Gene E. Tharp, both of St. Paul, Minn.

[73] Assignee: Minnesota Mining and Manufacturing Company, St. Paul, Minn.

[21] Appl. No.: 142,017

[22] Filed: Jan. 11, 1988

Related U.S. Application Data

[63] Continuation-in-part of Ser. No. 47,654, May 8, 1987, abandoned.

[51] Int. Cl.[4] ..... B32B 3/02; B32B 33/00

[52] U.S. Cl. ..... 428/88; 428/89; 428/92; 428/97

[58] Field of Search ..... 428/88, 89, 92, 97; 15/238

[56] References Cited

U.S. PATENT DOCUMENTS

| | | | |
|---|---|---|---|
| 4,045,605 | 8/1977 | Breens et al. | 428/88 |
| 4,353,944 | 10/1982 | Tarui | 428/78 |
| 4,461,791 | 7/1984 | Matsui et al. | 428/15 |
| 4,546,020 | 10/1985 | Sakai et al. | 428/16 |

*Primary Examiner*—Marion C. McCamish

*Attorney, Agent, or Firm*—Donald M. Sell; Walter N. Kirn; Richard Francis

[57] ABSTRACT

A tufted carpet having a backing which has thereon a plurality of tufts of fine denier fibers and a plurality of tufts of stiff, crimped, coarse denier fibers. A preferred pattern of tufts is alternate stripes or a checkerboard of areas consisting essentially of tufts of one type of fiber in an area.

14 Claims, No Drawings

TUFTED CARPET WITH TUFTS OF FINE FIBERS AND TUFTS OF CRIMPED COARSE FIBERS

Related Patent Applications

This is a continuation-in-part of copending U.S. application Ser. No. 047,654, filed May 8, 1987, now abandoned.

BACKGROUND OF THE INVENTION

1. Field of the Invention

The invention relates to tufted carpeting material, particularly carpeting material useful as an entry mat to remove dirt and water from shoes.

2. Background Art

Various devices have been employed at the entryways of buildings to reduce or remove the accumulation of various solid materials (hereinafter referred to merely as "dirt") and water typically found on the shoe soles and other pedestrian surface contacting parts of the shoe such as the heel (all of such parts hereinafter being referred to as the "shoe soles") of persons entering the building. Such devices typically include a mat which provides a brushing or wiping action against the shoe sole.

Such mats are generally fibrous or fabric in nature to provide the desired frictional surface and wiping action. Most fabrics or fibrous mats are not, however, completely satisfactory because they have a very limited capacity for storage of removed dirt and water and most are not particularly conducive to the rapid evaporation of water. They require frequent shaking and washing to rejuvenate the mats for subsequent uses.

Attempts have been made to provide floor mats which have a greater capacity for the storage of accumulated dirt, but these have generally been somewhat less than satisfactory. For example, lengths of solid materials such as edgewise oriented pieces of metal or segments of cut up automobile tires have been linked together, leaving spaces therebetween, to provide for the storage of dirt and other debris. Such mats, however, are not satisfactory because, besides being poor water absorbers, they leave the dirt removed plainly in view and they also require that the dirt be collected and removed after the mat is displaced since such mats generally have no bottom layer.

Some fabric or fibrous mats are unattractive and/or fail to provide a luxuriant underfoot surface. The more attractive and luxuriant mats are generally formed of very dense carpet pile, providing a surface with only a limited capacity for the storage of dirt and a structure from which water will be evaporated slowly.

Such carpet mats typically consist of a heavy backing attached to keep the mat in place upon which are deployed tufted fibers typically on the order of 6 to 15 denier per filament, a common fiber size for conventional carpeting material. While these fibers look good and have a pleasing texture when used in carpet, a mat of such conventional carpet fibers presents a rather closed surface which has little if any space to store and conceal dirt. Such a shortcoming gives rise to a phenomenon known in the entryway mat business as "retracking".

Retracking occurs when removed dirt on the surface of a mat such as tufted carpet with insufficient dirt storage space remains on the top of the mat and is picked up by the next person walking over the mat, causing the dirt to move further along on the mat until it is eventually carried into the building.

While mats containing larger denier fibers, such as those formed of coir (sometimes called "coco") fibers, fibrillated polypropylene film or large denier vinyl fibers, provide a sufficiently open mat to store dirt between such fibers, the large denier fibers are not very effective in absorbing and evaporating water.

U.S. Pat. No. 4,045,605 (Breens et al) discloses a carpeting material which includes pile or tuft fibers comprising 75 to 98% by weight of conventional carpet fibers and 2 to 25% by weight of stiff fibers or filaments arranged, not to provide openness to store removed dirt, but to act as dirt scrapers. The stiff fibers are not crimped. The conventional carpet fibers are less than 30 decitex per filament (about 27 denier) while the stiff fibers or filaments are of from 30 to 300 tex (about 270 to about 2700 denier). (The term "denier" refers to the weight in grams for a 9,000 meter fiber while the term "tex" refers to the weight in grams for a 1,000 meter fiber. Decitex is one-tenth of tex. A 0.11 tex fiber, or 1.1 decitex fiber would be 1 denier.) While Breens et al indicate that the stiff fibers may be fed in with each row of conventional pile or tuft yarn or in alternate rows or less frequently, using a conventional tufting machine or carpet loom, Breens et al also contemplate one or more rows of tufts of conventional carpet yarn followed by a row of stiff fibers or filament. Such an arrangement would not provide sufficient openness for the storage of removed dirt.

SUMMARY OF THE INVENTION

The present invention provides a tufted carpet mat which is particularly suited for pedestrian traffic. The mat of the invention may be advantageously used at the entryway of a building to wipe wet and/or dirty shoe soles. The mat of the invention overcomes many of the deficiencies noted above, providing a luxuriant, attractive, durable surface capable of wiping shoe soles, receiving, obscuring and holding therein dirt removed from shoe soles, wiping water from the shoe soles and facilitating evaporation of water.

Generally, the tufted carpet mat of the invention is comprised of a backing having thereon a plurality of tufts of fine denier fibers and a plurality of tufts of stiff, textured or crimped, coarse denier fibers. The tufts of coarse denier fibers may be mixed, either randomly or in an ordered pattern within tufts of fine denier fibers. One way of accomplishing this is by overtufting the coarse denier fibers onto a backing which already bears or is simultaneously tufted with the fine denier fibers to provide tufts of coarse denier fibers mixed with the tufts of fine denier fibers. The relative proportion of tufts of crimped, coarse denier fibers to tufts of fine denier fibers should be adjusted to provide sufficient wiping action and water absorbency, thought to be a function mainly of the tufts of fine denier fibers, and sufficient openness to collect and obscure collected dirt, the latter being a function mainly of the tufts of crimped, coarse denier fibers. Preferably, the tufts of fine denier fibers are in areas separate from areas of the tufts of coarse denier fibers. Most preferably, the areas of tufts of fine denier fibers separate the areas of tufts of coarse denier fibers as in a checkerboard pattern or a pattern of alternate stripes of each area. Each of the areas is preferably at least about 2 mm in its smallest dimension, that being the approximate width of one row of tufts of a typical crimped, coarse denier fiber, to provide an adequate space for storage of dirt, but no more than 500 mm in its smallest dimension so that the shoe sole of a pedestrian will always contact both areas with each step. The preferred carpet has a checkerboard pattern with the areas being shaped substantially as rectangles, each area preferably being about 2 to 50 $cm^2$ in size.

The fine denier fibers preferably are about 15 to 50 denier per filament (dpf) and the coarse denier fibers are preferably about 150 to 500 dpf. The total weight ratio of fine denier fibers to coarse denier fibers in the tufted carpet is preferably on the order of 1:3 to 3:1. The carpet preferably has a tufted pile face weight of at least about 600 9rams per square meter and a pile height of at least about 0.5 cm.

The preferred pattern of fine denier and coarse denier areas is a checkerboard pattern or stripes with an area of coarse denier fibers being adjacent to an area of fine denier fibers in the checkerboard or the stripe pattern. The areas of tufts of fine denier fibers and the areas of tufts of coarse denier fibers may be of the same IO height, but preferably the areas of tufts of coarse denier fibers are of a lower height than the height of the tufts of fine denier fibers to provide depressions for collecting dirt directly over the tufts of coarse denier fibers. The collected dirt will then be received in the open spaces provided within the tufts of coarse denier fibers because these fibers are crimped. Crimping endows the areas containing the tufts of coarse denier fibers with a very open structure which is capable of easily receiving and obscuring dirt once it enters therein. The tufts of fine denier fibers provide a wiping action against the shoe sole which removes dirt therefrom.

The preferred carpet mat of the invention includes tufts of cut fine denier fiber and tufts of looped, crimped, coarse deneir fibers. While the coarse denier fibers may be cut, it is preferred that they be uncut, thereby making the carpet mat easier to clean.

The fine denier carpet fibers are preferably nylon, acrylic, regenerated cellulose, wool, polyester, cotton or polypropylene fibers, or a mixture of two or more of these. The stiff, coarse denier fibers are preferably nylon, polyester, or polypropylene.

DETAILED DESCRIPTION

The tufted carpeting of the present invention may be produced by conventional carpet making equipment. A useful commerically available carpet making device may be obtained from Tufting Machine Division of TUFTCO Corporation of Chattanooga, Tenn. Tufting is a process whereby tufts of yarn are inserted into a backing material, called a "primary" backing, typically formed of woven or non-woven fabric. Yarn, as is well known, is a collection or a bundle of crimped fibers of the appropriate size, in continuous or discontinuous lengths. The tufts of yarn are inserted by vertical, reciprocating needles similar to conventional sewing machines. A conventional tufting machine is like a giant sewing machine having hundreds of threaded needles held in a needle bar over a bed plate across the width of the machine. The needles receive the yarn from large beams or cones arranged in racks or a creel. Yarns of the coarse denier fibers are fed to spaced collections of needles on the needle bar which are spaced to produce spaced areas of tufts of the coarse denier filament. Yarns of the fine denier fibers are fed to needle collections on the needle bar which occupy the space between the needles receiving the coarse denier fibers to produce tufts of fine denier fibers between the tufts of coarse denier fiber, usually to cover the carpet surface with tufts to provide a continuous tufted area of separated areas of tufts of coarse denier fiber and separated areas of tufts of fine denier fiber.

The yarns are tufted on the primary backing typically in side by side rows usually with at least two rows of tufts of the coarse denier fibers being deployed between rows of the fine denier fibers. The simplest structure to produce is a matting with alternate stripes of tufts of coarse denier fibers and fine denier fibers with stripes in straight lines along the entire length or width of the primary backing.

An alternative method involves forming an initial collection of tufts, much as one would do to produce a striped pattern, but then shifting the needle set by employing a shifting bar to displace the row, typically displacing it about two tufts from its original path, starting a new striped pattern in the displaced location, then, after at least two tufts are made in the new location, shifting back to the original striped path, and repeating this shifting back and forth to produce a checkerboard pattern. Other variations are possible to obtain the tufted areas.

While it is possible to use a conventional carpet tufting machine to make a tufted carpet having alternate stripes of tufts of the coarse denier fibers and the fine denier fibers, such a tufting machine usually requires some alteration to make it suited for use to make a tufted carpet according to the present invention with a checkerboard pattern. This may be mechanically accomplished by the addition of a shifting cam. The shifting cam displaces the needles from an original tufting path to a path which is displaced from the original path, usually one or two tufts on one side or the other side of the original path, to make the checkerboard pattern.

The primary backing into which the yarns are inserted is usually supplied in roll form, typically located in front of the machine. Spiked rolls, typically positioned on the front and back sides of the tufting machine, draw the primary backing over the bed plate and through the machine. The speed of the spiked rolls controls the number of stitches per unit of length. Moving the primary backing slower produces more stitches per unit length while a faster rate produces fewer stitches per unit length.

Typically, located below the bed plate of the tufting machine are looper and knife combinations which pick up and hold momentarily the yarns carried by the needles. The loopers work is timed with the stroke of the needles. When tufting cut pile, the looper and knife combinations hold and cut the yarns in a single operation. As the backing advances through the machine toward the cut pile loopers, the yarns picked up from the needles are cut with a scissor-like action between the back of the looper and knife cutting against the edge of the looper. Except for the selection of the type and the appropriately sized fibers and the production of tufted carpet with separate areas of tufts of coarse denier fibers and areas of tufts of fine denier fibers, the tufting equipment and process are well known in the art.

The coarse denier fibers are crimped to give the area containing these coarse denier fibers sufficient openness to receive and hide dirt and debris. The coarse denier fibers are used in the process of making the tufted carpet of the invention as yarns. Such yarns are made up of a plurality of crimped coarse fibers, typically with about 10 to 20 fibers per yarn. Crimping should be sufficient to give the fiber sufficient three-dimensional structure to form a tuft which can have sufficient space to receive dirt and sufficient entanglement of fibers to hide or obscure dirt within the area of tufts of coarse denier fibers. Crimping by conventional means, e.g., stuffer box, produces adequate results. Conventional tufting machines usually require that the coarse yarns be made up of continuous fibers for processability.

The fine denier fibers may be made of filaments which are either continuous or staple in yarn sizes that are commonly used to make conventional tufted carpet. The fine denier fibers are usually textured. Such conventional carpet yarns are typically on the order of about 6,000 denier with about 200 to 300 fibers per yarn.

The face weight is determined by yarn spacing (or machine gauge) as well as tuft length (pile height), yarn denier and stitch rate. If the pile height is too high, the fibers tend to lay over on themselves and could interfere with the dirt storage capacity. A pile height which is too high may also provide a tripping hazard. If the fiber or pile height is too low the dirt hiding capacity is diminished. If the stitch spacing is too tight, the tufted carpet may not have sufficient openness for the storage of dirt.

Tufted pile height of at least 5 mm is preferred for adequate dirt hiding capacity and the tufted pile height should preferably not exceed 15 mm. The most preferred tufted pile height is on the order of 9 to 15 mm. Cleaning is also easier if the pile thickness is less than 15 mm.

The primary backing is fabric which may be woven or non-woven and may be formed of natural or synthetic fibers. Preferred materials for forming the primary backing include the materials that are customarily employed for conventional carpet backing including, for example, natural fibers such as those made of jute or cotton, and synthetic fibers preferably those made of polyester or polypropylene. The preferred primary backing weight is on the order of 135 g/m$^2$. The fibers or filaments of the primary backing may be formed of slit film, extruded filaments or other conventional fibers formed in a conventional manner by any of a variety of processes. The primary backing may have needletacked to it a non-woven mat to provide a locking affect for the tufts and to prevent the backing material from unraveling. Such backings are well-known to those skilled in the carpet making art and this description is only given for purposes of illustration and to indicate that such conventional primary backings are useful in producing the tufted carpet of the present invention.

The tufted carpet of the present invention preferably includes a secondary backing which provides weight or body to the carpeting material to prevent it from being displaced as it is being walked over. The secondary backing is formed of conventional materials known for this purpose. The preferred secondary backings include those made of vinyl plastisol, polyurethene, rubber latex and similar materials. The secondary backing may be foamed, patterned such as in a waffle pattern, or ribbed. The secondary backing may also be filled with materials conventionally used in such backings for carpet mattings.

The tufts may be formed on the backing without utilizing a conventional tufting carpet machine. One way of forming the tufts in this manner is described in U.S. Pat. No. 3,943,028, the disclosure of which is incorporated herein by reference for a teaching for the preparation of a carpet without using a conventional tufting machine.

EXAMPLES

The invention is further illustrated by the following examples, all parts are by weight unless otherwise specified.

EXAMPLES 1-4

A conventional straight stitch cut pile tufting machine available from TUFTCO Corporation having a 9 to 13 mm pile height capability and a hydraulic shifting needle bar so as to produce a checkerboard carpet tuft pattern was used. A "square" tufting stitch with a stitch spacing of 5 mm was made in a 135 g/m$^2$ woven primary backing formed of woven polypropylene slit film filaments having needletacked to it a polypropylene non-woven web. This primary backing is available under the trade designation "Polybac" FLW style 2483 from Amoco Fabrics Company. A 7900 denier yarn of fine denier fibers was formed of 37 dpf continous polypropylene filaments and a 6500 denier yarn of coarse denier fibers was formed of crimped 300 denier polypropylene fibers, providing a weight ratio of coarse 300 dpf fibers to 37 dpf fine fibers of about 45:55.

The tufting machine needles were threaded in an "AABB" arrangement wherein two adjacent needles were threaded with the 37 dpf fiber yarn, the next two needles with the 300 dpf fiber yarn, and repeating this sequence throughout the length of the needle bar. Knives were fixed on the loopers to make a cut pile fabric.

Example 1 was a carpet sample made without shifting the needle bar so a striped pattern was obtained with alternate pairs of rows of the two fibers.

Example 2 was made in the same manner as Example 1 except the needle bar, after initially stitching 7 stitches, was shifted two spaces away from the initial stitch path, stitching 7 stitches, shifting two stitches in the opposite direction of the initial shift, and repeating this stitching and shifting pattern to produce a checkerboard pattern of slightly elongated rectangles.

Control example 1 was a control carpet containing only fine denier 37 dpf fibers and made similar to the process described in Example 1.

Control example 2 was also a control carpet containing only coarse denier 200 dpf fibers and made similar to the process described in Example 1.

The face weight of Examples 1 and 2 and Control examples 1 and 2 varied from 750 to 1000 g/m$^2$, and the pile height was 9.5 mm. Each of the carpet examples described above was backed with a 2700 g/m$^2$ filled vinyl plastisol as is commonly used on such walk-off mats. This plastisol consisted of about 32% mixed plasticizers, 36% vinyl acetate/polyvinylchloride copolymer, 28% fillers and small amounts of surfactants and pigments. The plastisol secondary backing was formed by coating the plastisol on a carrier belt, laying and forcing the primary backing side of the carpet sample into the liquid plastisol and fusing the plastisol at 150° C. for about 10 minutes in a hot air oven.

Control example 3 was a commercially available walk off mat which consisted of a 50 dpf polypropylene fiber tufted carpet having a face weight of about 1000 g/m$^2$ and a 2700 g/m$^2$ secondary flexible rubber-like backing which was commercially available under the trade designation Crown "Tuff'n Tidy" and sold by Ludlow Composites Company.

Water Absorption Test

Each of the example carpets were tested to determine the amount of water each would absorb from the shoe sole of the test foot in a Water Absorption Test.

The test device was originally built as a wear tester for deck covering according to Mil-D-16651D. The test device includes a 380 mm diameter horizontal turntable which is rotated at about 23 revolutions per minute beneath a vertically moveable shaft with its longitudinal axis deployed 130 mm from the axis of rotation of the turntable. Affixed to the end of the shaft closest to the surface of the turntable by two recessed bolts is a 50 mm diameter "foot" made of 3 mm thick tanned shoe sole leather. As the turntable rotates, the shaft lifts the foot approximately 12 mm from a rest position above the turntable surface whereupon it is released to drop back or "step" on the turntable surface at the rate of six times per revolution or 138 times per minute. The combined weight of the shaft and foot was 1.7 kg. On the turntable surface are mounted and restrained two split annular carpet samples, each defined by a half annulus with a 400 mm outside radius and a 130 mm inside radius. The two half annuli are clamped to the turntable by an inner retaining ring and a thin metal strap which bridged the gap between the half annuli. One of the half annuli carpet samples is fully saturated with water to provide a wet surface from which the shoe will pick up water. The other half annulus is the test sample which is weighed dry prior to the test.

The half annulus sample which is saturated with water was available from the Minnesota Mining and Manufacturing Company under the designation All Weather "Nomad" mat. Water is added to this mat to fully saturate it until water is observed at the surface of the mat The equipment is tested to determine adequate performance by using as the other half annulus test carpet another sample of All Weather "Nomad" matting. The equipment is run for 100 revolutions or cycles whereupon it was stopped, additional water is added to the saturated mat, and this sequence repeated, adding additional water after each 100 cycles until 500 cycles have been completed. The initially dry test sample is then reweighed, its dry weight is subtracted from its wet weight and the weight in grams reported. The water pickup for the All Weather "Nomad" mat typically is on the order of 62.5 to 66.5 grams for an average of 64.5 grams with the standard deviation of about 2 grams.

Water adsorption test results for Examples 1-2 and Control examples 1 and 2 are given in Table I.

TABLE I

| Example | Water Absorbed (g) | Face Weight g/m$^2$ |
|---|---|---|
| 1 (stripe) | 92 | 915 |
| 2 (check) | 119 | 750 |

TABLE I-continued

| Example | Water Absorbed (g) | Face Weight g/m$^2$ |
|---|---|---|
| Control 1 | 92 | 915 |
| Control 2 | 56 | 815 |
| Control 3 | 78 | 1020 |

It was surprising to note that the amount of water absorbed by the carpet of the invention, Examples 1 and 2, was no less than Control example 1 and greater than Control Example 2. This was completely unexpected since it was thought that the amount of water absorbed would be closer to the average weight of the water absorbed by Controls 1 and 2.

Dirt Removal Test

Testing for dirt removal and dirt trapping was done by measuring the amount of dirt left on the mats by people walking through a 1.8 m long by 0.9 m wide tray, containing 12.6 kg sand, onto a 1.5 m long by 0.9 m wide test mat. After wallking on the test mat, the people walked on buffer mats to thoroughly clean the shoes before repeating walking into the tray of sand, onto the test mat, etc. In this test, the same 20 people repeated the cycle 25 times. At the conclusion of the dirt removal test, the test mat was weighed, and weight compared with test mat weight prior to the test to determine dirt stopped.

Results of this test are given in Table II.

TABLE II

| Example | Dirt Stopped (g) |
|---|---|
| 1 | 908 |
| 2 | 1078 |
| Control 1 | 936 |
| Control 2 | 985 |
| Control 3 | 936 |

EXAMPLES 3-6

CONTROL EXAMPLES 4 AND 5

In these examples, a designed experiment was conducted to determine the effect on water removal capabilities of varying the ratio of large denier and small denier fibers.

Examples of tufted carpet were prepared by methods used in Example 2, except the weight of each yarn was varied. Table III summarizes the results.

TABLE III

| | Yarn A | | Yarn B | | | | |
|---|---|---|---|---|---|---|---|
| Ex. No. | (25 dpf) Total | % | (300 dpf) Total | % | Face Wt. g/m$^2$ | Water Absorbed (grams) | Dirt Stopped (g) |
| 3 | 7200 d | 50 | 7200 d | 50 | 985 | 130 | 22 |
| 4 | 3600 d | 33 | 7200 d | 67 | 745 | 129 | 21 |
| 5 | 5400 d | 49 | 5700 d | 51 | 815 | 136 | 25 |
| 6 | 7200 d | 62 | 4300 d | 38 | 850 | 115 | 24 |
| C-4 | 7200 d | 100 | — | — | 915 | 92 | 19 |
| C-5 | — | — | 7200 d | 100 | 745 | 52 | 20 |

This chart shows that ratio of fine and coarse fibered yarn from about $\frac{1}{3}$ to $\frac{2}{3}$ to $\frac{2}{3}$ to $\frac{1}{3}$ are more effective than either all fine or all coarse denier fibers.

EXAMPLES 7-10

In order to learn the effect on mat performance of the large denier fiber in the mat, a series of tufted mats was prepared similar to that given in Example 1 and according to the specifications shown in Table IV.

TABLE IV

| Ex. No. | Small Denier Fiber Fiber Size | Small Denier Fiber Yarn Denier | Small Denier Fiber Total % | Large Denier Fiber Fiber Size | Large Denier Fiber Yarn Denier | Large Denier Fiber Total % | Face Weight ($g/m^2$) | Water Absorbed (grams) |
|---|---|---|---|---|---|---|---|---|
| 7 | 37 d | 8100 | 56 | 170 d | 6000 | 44 | 950 | 83 |
| 8 | 22 d | 4300 | 45 | 273 d | 6500 | 55 | 815 | 92 |
| 9 | 37 d | 8000 | 52 | 300 d | 7400 | 48 | 915 | 92 |
| 10 | 22 d | 5400 | 52 | 410 d | 5000 | 48 | 745 | 76 |

The last column shows the effect on the water absorbing properties of this variation. A preference for large denier fibers in the region of 300 dpf is noted.

EXAMPLE 11

CONTROL EXAMPLE 6

Control Example 6 is made according to the disclosure of Breens, U.S. Pat. No. 4,045,605. Control Example 6 was made following the specific example disclosed by Breens except using the fibers identified below, which fall within his teaching. The specific fibers disclosed by Breens were unavailable. This was done in order to compare the performance of a carpet of uncrimped coarse denier fibers blended with fine denier fibers to a carpet of the invention (Example 11) which consisted of areas of crimped coarse denier fibers and of fine denier fibers. The types of fibers and carpet face weight and pattern are set forth in Table V, as are the water absorbency test results.

TABLE V

| Ex. No. | 22 dpf Yarn | 300 dpf Yarn | Face Wt. $g/m^2$ | Pattern | Water (g) |
|---|---|---|---|---|---|
| C-6 | 75% | 25% | 815 | Uniform/Blended | 87 |
| 11 | 67% | 33% | 745 | Same as Ex. 2 | 129 |

Control example 6 was prepared using uncrimped 300 denier coarse denier filaments uniformly blended into the 22 dpf yarn. Example 11 had fibers arranged in a two stitch wide by 7 stitch long rectangular pattern as described in Example 2. Even with the advantage of a higher face weight for Control example 6, its water absorption properties were much less than a carpet having discrete areas of crimped coarse denier fibers according to the invention.

EXAMPLES 12 AND 13

EXAMPLE 12

A carpet mat consisted of areas of looped tufts of fine denier fibers and areas of looped tufts of crimped coarse denier fibers. A 5 mm (3/16 inch gauge tufting machine with an in-line needle bar with loopers instead of knives was used. The needles were threaded with 6000 denier textured yarn composed of 25 dpf polypropylene textured fine filaments (each tuft of fine filaments being referred to by "A") and 6000 denier textured yarn composed of 170 dpf polypropylene coarse filaments (each tuft of coarse denier filaments being referred to by "B") in an AAAA, BBBB sequence. Eight rows of tufts were produced in sequence on an original path, each row having the AAAA, BBBB alternate sequence. The needle bar was then shifted to displace each needle path from the original path by two rows and a single row of tufts produced. The needle bar was again shifted to displace each needle path from the original path by a total of four rows and eight tufts produced on the new path. The needle bar was then returned to its original path in a reverse sequence, and the same sequence repeated to produce a checkerboard pattern of alternating rectangles 19 mm ($\frac{3}{4}$ inch) wide by 31.75 mm ($1\frac{1}{4}$ inch) long of 25 dpf yarn and 170 dpf yarn. Pile height was controlled to give an approximate 6.3 mm ($\frac{1}{4}$ inch) pile height and a 866 $g/m^2$ (26 oz. per square yard) face weight of total fiber.

EXAMPLE 13

Example 13 was prepared in exactly the same way as Example 12 except the 170 dpf yarn was stitched at a lower pile height, about 1.6 mm (1/16 inch) lower than the 25 dpf yarn. The resulting carpet had the same finished appearance as Example 12 except the rectangles of the 170 dpf yarn were about 1.6 mm (1/16 inch) lower than the rectangles of 25 dpf yarn. The carpet so produced was passed under a reel type cutter called a tip shear which was adjusted to cut the looped tops of the 25 dpf yarn. This created the plush type appearance in the 25 dpf rectangles of a cut pile carpet.

Examples 12 and 13 and Control Example 7, a commercially available tufted carpet mat consisting of 22 dpf polypropylene fibers, were tested for water absorbency with the results being shown in Table VI.

TABLE VI

| Example | Grams Water Absorbed |
|---|---|
| 12 | 101 |
| 13 | 105 |
| Control 7 | 78 |

This result clearly shows the superiority of Examples 12 and 13 in the ability to remove and trap water.

EXAMPLES 14 TO 26

Examples 14–26 describe the preparation of carpet mats having looped tufts of crimped coarse denier fibers. These carpet mats had excellent cleanability.

EXAMPLES 14–18

A mat according to the invention was made with a high-low tufted loop configuration. A 5 mm (3/16 inch) gauge tufting machine with loopers to catch the yarn from the needles was threaded with a AAAA, BBBB repeating yarn configuration. The machine had a shifting needle bar and was adjusted to shift four rows every six stitches. This gave a pile carpet consisting of tufts of looped fine denier fibers and tufts of looped crimped coarse denier fibers having 100×150 mm rectangular areas. The tension on the yarn was adjusted so that the fine denier yarn loops were about 1.6 mm (1/6 inch) higher than the coarse denier fiber yarn loops. The loops of fine denier fiber were then sheared using a conventional tip shear, giving a plush appearance to the areas of carpet than have the fine denier fiber tufts.

Yarn A, providing the fine denier fiber, was a 6000 denier yarn made of 25 dpf polypropylene fiber. Yarn B, providing the coarse denier fibers, was the crimped fiber identified in Table VII opposite the appropriate Example number.

TABLE VII

| Example Number | Fiber dpf | Coarse Crimped Fibers Yarn Denier | Fibers in Yarn | Yarn Type |
|---|---|---|---|---|
| 14 | 300 | 4800 | 16 | polypropylene |
| 15 | 300 | 4800 | 16 | polypropylene |
| 16 | 170 | 6000 | 36 | polypropylene |
| 17 | 5,000[1] | | 1 | vinyl coated polyester |
| 18 | 300/22[2] | 4800 | 118 | polypropylene |

[1]A 30 mil diameter sheath-core filament with a 1,000 denier polyester core and a 4,000 denier polyvinyl chloride sheath.
[2]Air entangled combination of 8 ends 300 dpf and 110 ends of 22 dpf to provide a 4800 denier yarn.

The samples were tufted in a woven polypropylene primary backing and the resulting tufted mat was backed with a 2700 g/m$^2$ a (80 oz. per square yard) vinyl plastisol backing.

EXAMPLES 19–26

Examples 19–26 were prepared by overtufing coarse denier fibers onto a backing which was pretufted with fine denier fibers.

These examples were made on a tufting machine which had two needle bars arranged in a series. The first needle bar was of 3 mm (⅛ inch gauge) arranged to provide a cut pile carpet. The second needle bar was of 6.3 mm (¼ inch gauge) arranged to provide looped pile. The loop pile needle bar was also arranged so it shifted to provide a zig-zag pattern and the yarn fed to this needle bar was controlled by individually controlled tension rolls so the loop of coarse fiber was pulled to the primary backing so that it was not visible when viewing the surface of cut pile produced by the 3 mm (⅛ inch gauge) needle bar and did not extend to the same height as the fine fiber cut pile.

By selectively adjusting and varying the tension on the 6.3 mm (¼ inch gauge) loop yarn, a fabric was made in which none of the loops of coarse denier fibers was visible or in which every loop of coarse denier fiber was visible.

The carpet mat of Examples 19–26 used a 3 mm (⅛ inch gauge) cut pile needle bar threaded with 3000 denier, 25 dpf polypropylene yarn as the fine denier fiber. The coarse denier fiber is shown in Table VIII. The coarse denier fibers were threaded in each needle of the needle bar for Examples 19–21 and for Examples 22–26 in alternate needles of the needle bar to give an effective 13 mm (½ inch gauge) loop threading.

TABLE VIII

| Example Number | Fiber dpf | Yarn Denier | Fibers in Yarn | Yarn Type |
|---|---|---|---|---|
| 19 | 170 | 6000 | 36 | polypropylene |
| 20 | 170 | 6000 | 36 | polypropylene |
| 21 | 170 | 6000 | 36 | polypropylene |
| 22 | 170 | 6000 | 36 | polypropylene |
| 23 | 170 | 6000 | 36 | polypropylene |
| 24 | 37 | 7000 | 190 | polypropylene |
| 25 | 5,000 | — | 1 | vinyl coated polyester |
| 26 | 300/22 | 4800 | 118 | polypropylene |

Carpet mats made according to Examples 14–26 were tested for their ability to trap and hold water according to the Water Absorption Test. The results of this test are listed in Tables IX and X, respectively.

TABLE IX

| Example No. | Water Absorbed (g) | Carpet Pattern |
|---|---|---|
| 14 | 86 | rows |
| 15 | 113 | 4 stitches by 6 stitches, check |
| 16 | 111 | 4 stitches by 6 stitches, check |
| 17 | 101 | 4 stitches by 6 stitches, check |
| 18 | 107 | 4 stitches by 6 stitches, check |
| Control 7[1] | 70 | none |

[1]A commercially available tufted carpet mat consisting of 22 dpf polypropylene fibers.

From Table IX, it can be seen that a mat which contains combinations of crimped, coarse and fine fibers in discrete areas is preferable to a mat containing alternate rows of the same fibers and a mat consisting only of fine denier fiber. A preferred construction is Example 15 which absorbs and traps 43% more water than Control 7, a tufted 22 dpf polypropylene carpet mat commonly used in the industry today. This is quite unexpected since the larger denier fibers, especially those of a hydrophobic polymer such as polypropylene, would be expected to provide fewer and smaller interstitial spaces for water to be wicked to and stored.

Mats containing discrete areas, such as Example 15, absorb 31% more water than mats containing alternate rows of coarse and fine fibers, e.g., Example 14.

In reviewing the data of Table IX, the significantly improved water absorbing and trapping properties is evident in carpet mats made with looped pile crimped, coarse denier fibers in discrete areas in combination with fine denier carpet fibers of a size conventionally used in carpet. Mats of coarse denier fiber looped pile are preferred because they were easier to clean as compared to mats of cut pile coarse denier fiber.

Table X shows that similar water absorbency results can be obtained by overtufting loops of coarse crimped denier fibers on carpet mats of fine denier fiber.

TABLE X

| Example Number | Coarse Denier Fiber Size (dpf) | Water Absorbed (g) | Pattern | % Loops Exposed |
|---|---|---|---|---|
| 19 | 170 | 91 | Pin-dot | 80% |
| 20 | 170 | 103 | Checks | 25 |
| 21 | 170 | 88 | Random | 15 |
| 22 | 170 | 83 | Plain | 0 |
| Control 7 | | 70 | — | — |
| 23 | 300 | 125 | Checks | 25 |
| 24 | 37 | 99 | Checks | 25 |
| 25 | 5,000 | 88 | Pin-Dot | 50 |
| 26 | 170 | 112 | Checks | 40 |

An analysis of data of Table X illustrates the advantage of having loops of fiber randomly protruding above a cut pile carpet for improved water absorption. In addition, the data illustrates that larger fibers function better than smaller, but that some benefit is obtained from smaller loops as well.

Examples 19–26 show that there is more of a benefit by having the coarse denier fibers in discrete areas rather than being dispersed throughout the carpet mat.

All the Examples made according to the present invention had better performance than control carpet samples consisting entirely of fine denier polypropylene fibers such as is commonly used by the trade.

In sum, it has been found that incorporation of looped pile coarse denier fibers in patterns with fine denier carpet fibers produces a walk-off mat with superior water absorbing and holding capabilities. It has also been found that tufting loops of coarse denier fiber through a fine denier cut pile carpet can significantly increase the water absorbing and holding capability of a walk-off mat.

The present invention may be embodied in other specific forms without departing from its spirit or essential characteristics The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

We claim:

1. Tufted carpet copmrising a backing having thereon tufts of fine denier fibers and tufts of stiff, crimped, coarse denier fibers, said tufts of crimped, coarse denier fibers providing a very open structure in said carpet which is capable of easily receiving said obscuring dirt once it enters therein.

2. The tufted carpet of claim 1 wherein the fibers comprising the tufts of said stiff, crimped, coarse denier fibers are looped.

3. The tufted carpet of claim 2 wherein the fibers comprising the tufts of said fine denier fibers are looped.

4. The tufted carpet of claim 1 comprising a plurality of first areas consisting essentially of said tufts of fine denier fibers and a plurality of second areas consisting essentially of said tufts of crimped, coarse denier fibers.

5. The tufted carpet of claim 4 wherein each of said areas is from about 2 mm to about 500 mm in its smallest dimension.

6. The tufted carpet of claim 4 wherein said areas are in a checkerboard pattern.

7. The tufted carpet of claim 4 wherein said areas are continuous parallel stripes.

8. The tufted carpet of claim 4 wherein said areas are about 2 to 50 $cm^2$ in size.

9. The tufted carpet of claim 1 wherein said tufts of said stiff, crimped, coarse denier fibers are shorter than the tufts of fine denier fibers.

10. The tufted carpet of claim 1 wherein said fine denier fibers are about 15 to 50 dpf and said stiff, crimped, coarse denier fibers are about 150 to 500 dpf, and the weight ratio of said fine denier fibers to said coarse denier fibers is about 1:3 to 3:1.

11. The tufted carpet of claim 1 wherein said carpet has a tufted pile face weight of at least about 500 grams per square meter and a pile height of at least about 5 mm.

12. The tufted carpet of claim 1 wherein said fine fibers are formed from a material selected from the group consisting of nylon, acrylic, regenerated cellulose, wool, polyester, cotton and polypropylene.

13. The tufted carpet of claim 1 wherein said stiff coarse fibers are formed from a material selected from the group consisting of nylon, polyester and polypropylene.

14. Tufted carpet comprising a backing having thereon a plurality of first areas of tufts of fine denier fibers and a plurality of second areas of tufts of looped, stiff, crimped, coarse fibers, the tufts of looped, stiff, crimped, coarse denier fibers being shorter than the tufts of fine denier fibers, each of said areas being from about 5 mm to about 100 mm wide, said fine denier fibers being about 15 to 50 dpf, said stiff, coarse denier fibers being about 150 to 500 dpf, the weight ratio of said fine denier fibers to said coarse denier fibers being about 1:3 to 3:1, said tufted carpet having a tufted pile face weight of at least about 500 grams per square meter and a fine denier pile height of at least about 5mm.

* * * * *

UNITED STATES PATENT AND TRADEMARK OFFICE

CERTIFICATE OF CORRECTION

PATENT NO. : 4,820,566

DATED : APRIL 11, 1989

INVENTOR(S) : RICHARD F. HEINE ET AL.

It is certified that error appears in the above-identified patent and that said Letters Patent is hereby corrected as shown below:

Col. 3, line 13, "9rams" should be --grams--.

Col. 3, line 20, "same IO height" should be --same height--.

Col. 7, line 36, "mat" should be --mat.--.

Col. 11, line 20, "2700g/$m^2$a" should be --2700 g/$m^2$--.

Col. 11, line 24, "overtufing" should be --overtufting--.

Col. 13, line 9, "characteristics" should be --characteristics.--.

Col. 13, line 18, "copmrising" should be --comprising--.

Col. 13, line 22, "said" should be --and--.

Signed and Sealed this

Eleventh Day of June, 1991

*Attest:*

*Attesting Officer*

HARRY F. MANBECK, JR.

*Commissioner of Patents and Trademarks*